United States Patent [19]

Hemmer

[11] 4,085,526

[45] Apr. 25, 1978

[54] SOLE FOR ATHLETIC SHOE

[75] Inventor: Lorenz Hemmer, Ottersthal-Saverne, France

[73] Assignee: Adidas Fabrique de Chaussures de Sport, Landersheim, France

[21] Appl. No.: 710,145

[22] Filed: Jul. 30, 1976

[30] Foreign Application Priority Data

| | | |
|---|---|---|
| Aug. 1, 1975 | France | 75 24910 |
| Aug. 7, 1975 | France | 75 25290 |

[51] Int. Cl.[2] ..... A43B 23/28

[52] U.S. Cl. ..... 36/59 R

[58] Field of Search ..... 36/59 R, 59 B, 67 R, 36/67 A, 67 D, 134, 129, 43, 44,

[56] References Cited

U.S. PATENT DOCUMENTS

| | | | |
|---|---|---|---|
| 3,328,901 | 7/1967 | Strickland | 36/134 |
| 3,597,863 | 8/1971 | Austin | 36/59R |

FOREIGN PATENT DOCUMENTS

| | | | |
|---|---|---|---|
| 1,208,120 | 12/1958 | France | 36/129 |
| 362,234 | 8/1938 | Italy | 36/59 R |

*Primary Examiner*—Patrick D. Lawson

*Attorney, Agent, or Firm*—Brisebois & Kruger

[57] ABSTRACT

Sole for athletic shoe comprises inner sole of relatively hard plastic embedded in an outer sole of softer plastic. Cleats integral with the inner sole project through one surface of the outer sole.

8 Claims, 7 Drawing Figures

SOLE FOR ATHLETIC SHOE

SUMMARY OF THE INVENTION

This invention relates to a sole for a sports shoe and in particular for an athletic shoe, especially for racing over short and middle distances on artifical tracks made of synthetic materials.

Sports shoes, and especially those used in competition, on artificial tracks have specially designed soles of several different types which may be divided into two principal categories:

1. Those soles made of a plastic material in a single piece by injection. Roughened contact areas in the front half of the shoe sole are then formed in the material of the sole itself during injection. The lack of flexibility of the front halves of these soles in the direction of movement and in a direction lateral thereto as well as premature wear results in an article which is not very satisfactory in developing athletic performance.

The mediocre mechanical properties of this type of sole constitute a constraint on the athlete which prevents him from utilizing all the possibilities of the track.

2. Composite soles which comprise a hard front half-sole and a flexible extension beneath the arch and the heel with the front half-sole having a plurality of vertical metallic cleats, each screwed into a metallic base embedded in the mass of the sole or carried by supports formed in the material of the sole itself and projecting from its surface.

These metallic cleats are intended to avoid any slipping on the track and natural terrain made of fine compacted material.

Such soles, while not entirely satisfactory, are suitable for tracks of natural material, for example, cinders.

On the contrary, the presence of cleats becomes a positive handicap on artificial tracks made of continuous synthetic materials such as those known under the trademarks TARTAN AND RECORTAN.

The significant penetration of the cleats into the material results in real difficulty at each step when the shoe must be released.

Moreover, each penetration by the cleats perforates the material and results in rapid deterioration of these tracks, which are relatively expensive.

Looseness also develops rapidly at the level of the metallic bases and this results, during running, in a lack of precision of contact with the ground and, in the long run, a lack of equilibrium for the athlete.

Running shoes have already been made for artificial tracks in which the sole comprises several isolated cleats at their edges and roughness on the surface in contact with the ground. Such a sole is not satisfactory because the metallic bases in which the cleats are screwed are rigid and cover a large area so as to impair to a considerable extent the flexibility of the assembly comprising the sole. Moreover, such a sole damages the upper surface of the tracks.

The present invention proposes a sole for athletic shoes particularly adapted to running on artificial surfaces which avoids the disadvantages hereinbefore mentioned.

The structure of the sole also insures, while offering adequate flexibility, a free and sure contact between its front half and the track so as to offer the foot of the athlete a particularly good bearing surface. All the risks of slipping, both laterally and longitudinally are eliminated, insofar as possible.

A good equilibrium is provided at all times, as is excellent adherence and a correct bearing on the ground all along the course, thus permitting the athlete to attain his best performances.

It is an object of the present invention to provide the new article of manufacture which consists of a sole for a sports shoe, and especially an athletic shoe, comprising a front half sole formed from an inner sole made of a hard synthetic material equipped with cleats and embedded in a layer of more flexible synthetic material having two flat surfaces, said cleats projecting from one of the surfaces, said sole being characterized by the fact that the inner sole has a shape corresponding to the contour of the front half sole and a reticular structure having large meshes the junction nodes of which form seating zones, which are preferably circular, for cleats projecting from the structure and integral therewith.

In a preferred embodiment the inner sole comprises a peripheral edge having laterally and toward the front a curved border corresponding substantially to the outer contour of the front half of the sole closed at the back by a straight border which is substantially transverse with respect to the shoe, and a plurality of ribs forming a network inside the perimeter defined by said border, the width of said ribs being preferably less than the thickness of said border.

Advantageously the inner sole comprises, over at least part of its length, transverse spaced ribs substantially parallel to the straight edge of the border and longitudinal spaced ribs extending from said straight edge and crossing said transverse ribs, supporting zones for cleats being formed at the junction nodes between the longitudinal and transverse ribs and between said ribs and with their peripheral border.

The cleats thus extend in transverse rows parallel to the straight rear edge of the insole.

In a particularly preferred embodiment the inner sole comprises, in the vicinity of its front end, a plurality of diverging ribs radiating in a star shape from a common junction node, supporting zones for cleats being formed at said common junction node and at the junction nodes of said ribs with the peripheral border and the transverse rib furthest from said common junction node.

In an advantageous manner, each cleat has a cylindrical base in alignment with a supporting zone perpendicular to the plane of the network structure of the insole, said base merging into a substantially frusto-conical body having incurved sides and a cylindrical part adjacent its end plane, the length of which is preferably equal to the diameter of said end plane.

In a particular embodiment, the sole consists over its entire length of the same material as that in which the inner sole is embedded, the face of the sole from which the cleats project being advantageously provided, with roughened places, for example, substantially pyramidal in shape, in the zones of the sole corresponding to the arch and heel.

The sole according to the invention is particularly adapted to the techniques of commercial manufacture nd especially injection molding. Thus the insole is made in a first mold and, after cooling and removal from the mold, positioned in a second mold into which the material constituting the remainder of the sole is introduced. The structure of the insole permits excellent anchorage of the latter in the layer in which it is embedded.

The present invention also relates to new articles of manufacture in the form of athletic shoes provided with the said soles as well as inner soles for the manufacture of such soles.

Other characteristics and advantages of the invention will appear from the following description, with reference to the accompanying drawings, in which:

FIGS. 1 and 2 show an inner sole 1 according to the invention molded by injection and made of a hard synthetic material, such, for example, as a polyamide having an aromatic chain or the one sold under the tradename TROGAMID.

Figure 1:
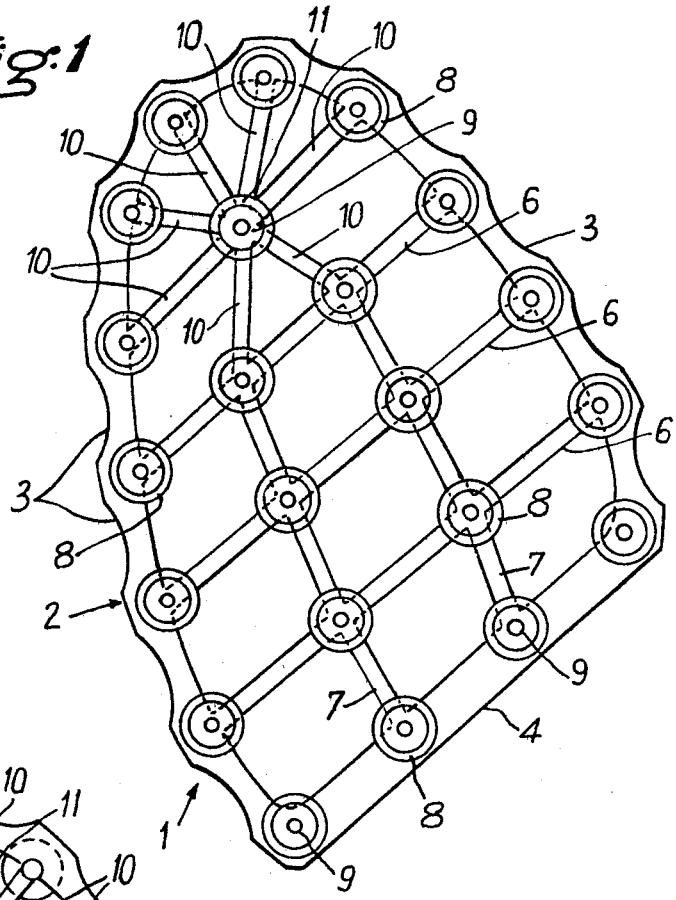
FIG. 1 is a plan view of the lower face of the inner sole of a sole according to the invention.
Figure 2:
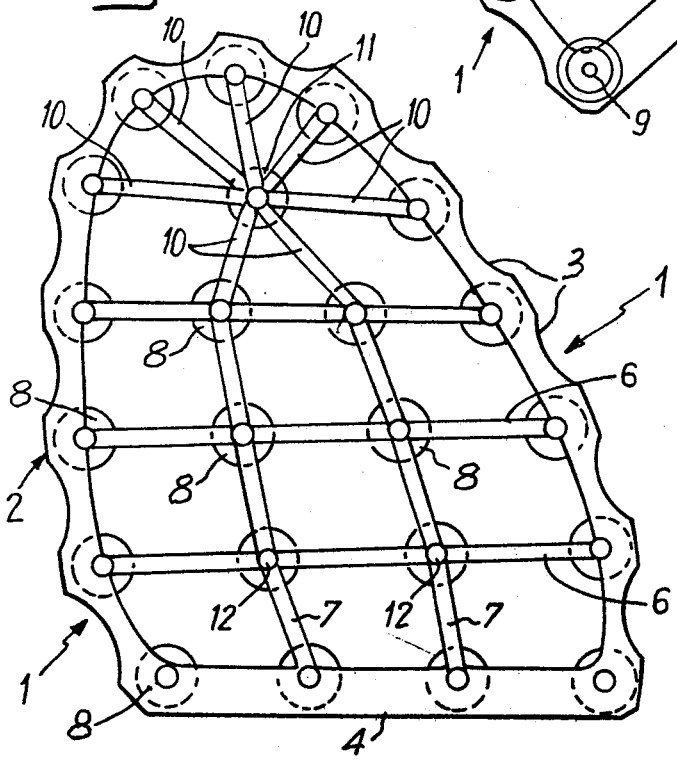
FIG. 2 is a plan view of the upper surface of the inner sole.

It has a peripheral border 2 having a curved contour laterally and at the front corresponding to the outer contour of the front half-sole of the sole. The border comprises a plurality of recesses 3. This curved contour is closed toward the rear by a straight edge 4. The insole comprises a plurality of ribs 6 (three in number in the example illustrated) spaced substantially parallel to the straight edge 4 and a plurality of spaced ribs 7 (to the number of two in the example) extending from the edge 4, substantially parallel to the lateral sides of the edge 2. At the junction nodes of the ribs 6 and 7 and between them and the edge 2 and the straight rear edge 4 are circular supporting zones 8, each carrying a cleat 9 which will be described in greater detail with reference to FIG. 7. Toward the front of the half sole the inner sole comprises a plurality of ribs 10 diverging from a common junction node 11 at which there is a circular supporting zone carrying a cleat 9. Such supporting zones are also formed at the junction nodes of the ribs 10 with the border 2. The insole is thus in the form of a flat network having large meshes, the junction nodes of which form supporting zones for projecting cleats made in one piece and from the same material. The ribs 7, 8 and 10 may also be slightly rounded on their rear surface and projecting pins such as 12 may also be provided on this surface, especially at the level of the junction nodes along the edge and the ribs, to immobilize the insole in the mold during the subsequent injection phase of the material forming the remainder of the sole and to insure better attachment of this material to the insole. The distribution of the ribs and thus of the number of junction nodes and cleats as well as the height thereof may be modified in dependence upon the particular exigencies of the discipline in question.

In the example illustrated, all the cleats are equal in height except possibly those at the periphery of the tip which are slightly shorter. The tip constitutes a large part of the surface in contact with the ground in the course of the effort. Thus it is principally on this small surface alone that the athlete contacts the ground and obtains, when running, the propulsive force necessary for the next movement.

The variation in the height of the cleats differs in accordance with the discipline. Sprint and running over short distances requires cleats the height of which decreases from the rear to the tip. In certain particular disciplines, such as high jumping and pole vaulting, the variation is in reverse, so that the height of the cleats increases from the rear to the front.

In order to produce a sole according to the invention, the inner presole is covered on its two surfaces with a holding layer 13 (FIGS. 3 to 7) made of a flexible synthetic material such as a polyamide having an aromatic chain, applied by not injection which becomes anchored in the meshes of the network covering the ribs 6, 7 and 10, the supporting zones 8 and the border 2, so as to cover them entirely so thickly that each cleat projects from the lower surface of the layer without any angular edge at the level of its base, and without any part of the inner sole projecting from the upper surface of the layer.

The holding layer extends uniformly and has two parallel surfaces. It has a slightly larger surface than the inner sole so as to cover the border thereof. It has, for example, a slightly roughened surface.

Figure 3:
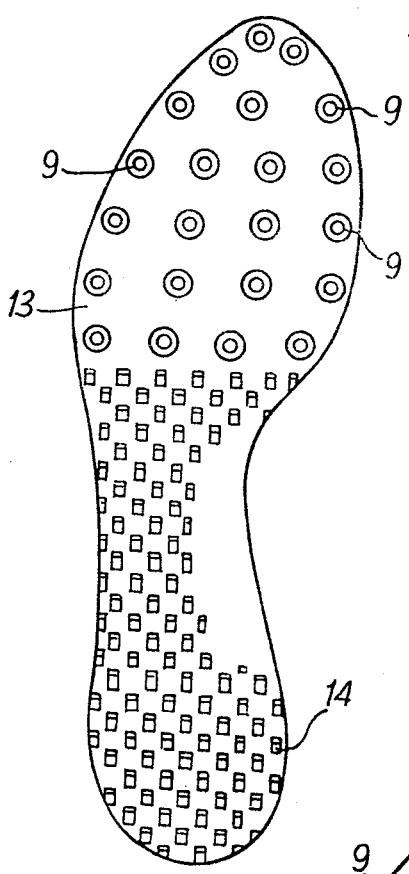
FIG. 3 is a plan view of an embodiment of the sole according to the invention.

In the case of particular applications e.g. shoes for 400m and 800 m athletic runs a complete sole such as shown in FIG. 3 is formed by injection and in one piece. This sole has on its rear part roughened places 14, which may for example be pyramidal, formed at the same time as said sole. This insures a good grip on the ground.

The process of manufacturing such a sole takes place in two steps. First the inner sole is made by hot injection in a mold to obtain the reticular structure and the cleats. After cooling and removal from the mold the inner sole is placed in a second mold in which the supporting layer 13 will be formed and subjected to supplemental injection under pressure. This produces an internal bond between the two materials forming respectively the inner sole and the supporting layer at the level of those of their surfaces which are in contact and perfect anchorage of the layer 13 in the spaces between the meshes of the network and around the bearing zones 8 and, on the other hand perfect, immobilization of the inner sole at the level of its border 2.

Figure 4:
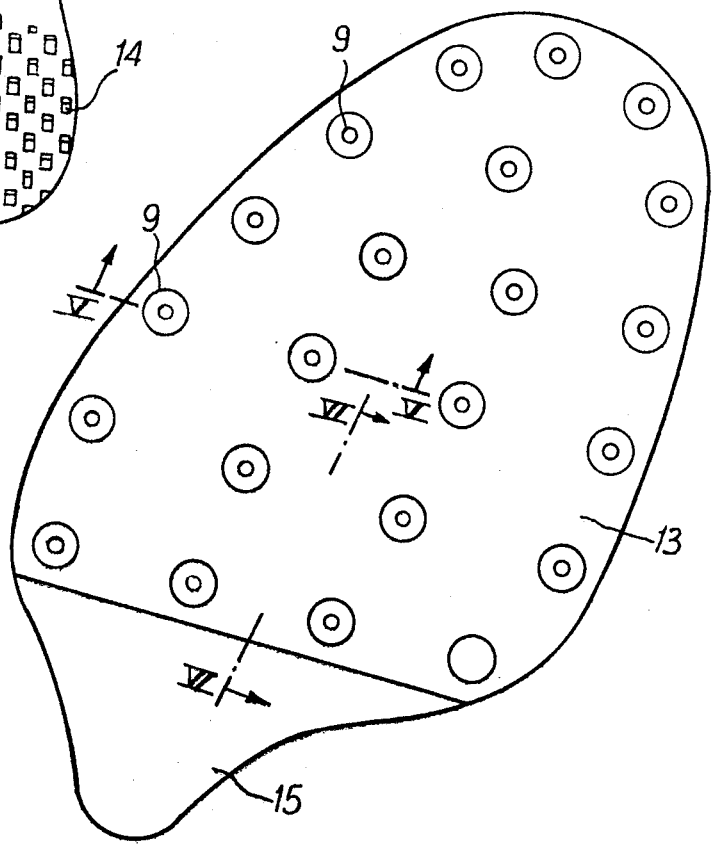
FIG. 4 is a plan view of a half-sole according to the invention.

FIG. 4 represents a front half sole usable in sprints, with the supporting layer 13 extending backwardly in the form of a flexible tongue 15.

Figure 5:
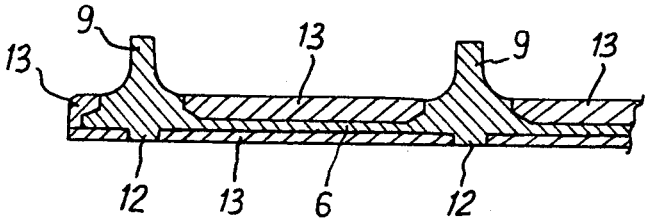
FIG. 5 is a sectional view of the sole according to the invention taken along the line V—V of FIG. 4.
Figure 6:
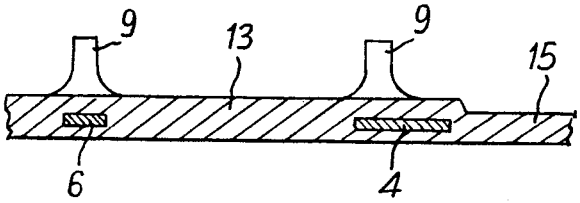
FIG. 6 is a sectional view of the sole according to the line VI—VI of FIG. 4.
Figure 7:
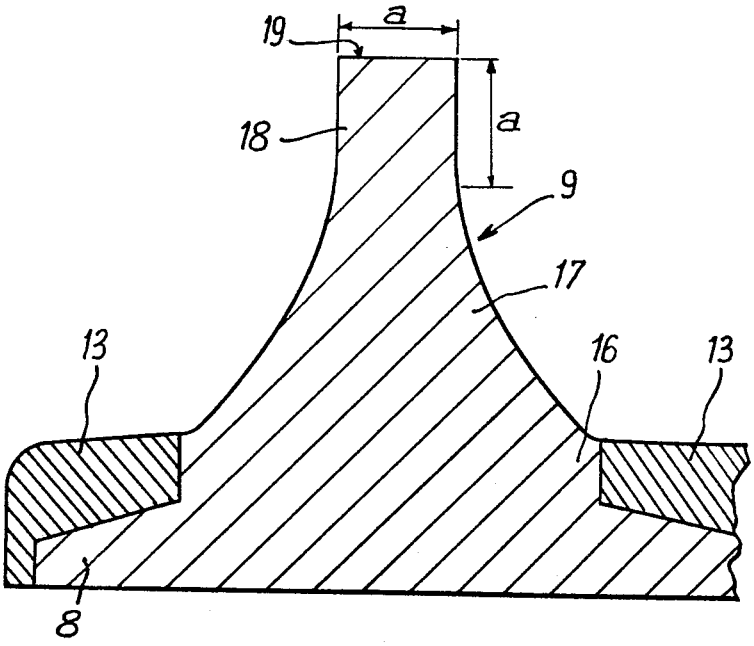
FIG. 7 is a sectional view on a larger scale taken through an end cleat.

FIGS. 5 and 6 illustrate how the inner sole may be immobilized in the supporting layer 13. The figures clearly show that the layer 13 has two opposed flat surfaces, from one of which the cleats project. FIG. 7 shows on a larger scale a cleat of the sole according to the invention.

Each cleat is formed in the material of which the inner sole itself is made. Each cleat rests on a supporting zone 8 having a circular section and comprises a cylindrical base 16.

This base merges upwardly into the body of the cleat, which has a generally frusto-conical form, with slightly incurved sides, which merges into an upper cylindrical part 18 and has at its end a flat face 19 parallel to the plane of the inner sole.

The upper part 18 has preferably a length *a* equal to its diameter.

The angles formed by the junctions between the body 17 of the cleat and its base 16 with the corresponding supporting zone 8 are clean, obtuse and nearly at a right angle, to facilitate the anchorage of the supporting layer 13.

The advantages of the sole according to the invention are many.

The cleats are formed by the same material as the light inner sole, are supported by circular bases separated from each other by the open meshes of the network structure which imparts a uniform flexibility to the assembly, both lengthwise and sidewise, and permits excellent flexing.

The weight of the athlete is well distributed over the entire surface of the sole. There is no penetration into the material of the track. There is no contact with the track except an identical local compression for each cleat, which does not produce any imbalance.

These characteristics make it possible to benefit from elastic support and a good impulse at each step. They also impart a good impulse to the foot without any trouble of any sort so that the runner may benefit from all the qualities of the track.

Because of the conical shape and incurved sides of the cleats, the instantaneous contact is free, sure, precise and efficacious. The quality of the contact insures exceptional transmission of energy.

When the end cleats are made a little shorter, this avoids any stumbling on contact with the ground by reason of the angle of attack of the foot on the ground, which assures a total support throughout the movement. This prevents any falling at the beginning and after the beginning when the athlete relaxes.

The sole is also remarkable for its great lightness due to the total absence of metal. The shoes which are so equipped are easier to wear and render all effort more efficacious. The muscular deformations and discomforts of which athletes complain after several months of running are minimized and the hardness of the shocks is reduced.

Its composite construction comprises a hard insole provided with cleats and a flexible cover layer which insures good flexibility to the assembly.

While the invention has been described in detail in connection with a particular embodiment thereof, it is obvious that it is clearly not limited to this particular embodiment and that modifications, especially as to form and material, may be adopted without thereby departing from the basic principles of the invention.

What is claimed is:

1. Inner sole adapted to be used in a sole for an athletic shoe, which inner sole is made of a hard synthetic material and has a shape corresponding to the shape of the front half of the sole and a flat reticular structure with large meshes, the junction zones of which form supporting zones for cleats which project from the structure perpendicular to its plane and are integral therewith.

2. In a sole for an athletic shoe comprising a half-sole formed from an inner sole made of a hard synthetic material and provided with cleats, said inner sole being embedded in a layer of a more flexible synthetic material having two flat surfaces with said cleats projecting from one of said surfaces, the improvement according to which said inner sole has a flat reticular structure with large meshes, said structure comprising a peripheral border having a curved lateral and front contour-corresponding substantially to the exterior contour of the front half-sole of said sole, said border being completed at the rear of said half-sole by a substantially straight transverse edge portion which extends transversely with respect to the sole, and said inner sole further comprising, over at least part of its length, spaced transverse ribs substantially parallel to the straight portion of the border and at least one longitudinal rib extending from said straight portion and crossing the transverse strips, supporting zones for the cleats being provided at the junction nodes between said at least one longitudinal rib and said transverse ribs and between said longitudinal and transverse ribs and the peripheral border, said cleats projecting from the structure perpendicular to its plane and being integral therewith.

3. Sole as claimed in claim 2 in which the inner sole comprises near its front end a plurality of ribs in the form of a star diverging from a common junction point, zones for supporting cleats being formed at said common junction point and at the junction points between said ribs and the peripheral border and the transverse ribs furthest from said common junction point.

4. Sole as claimed in claim 2 in which the width of said ribs is less than the width of said peripheral border.

5. Sole as claimed in claim 2 in which each cleat has a cylindrical base mounted on a circular supporting zone and is perpendicular to the plane of the network structure of the insole, said base merging into a substantially frusto-conical body having incurved sides and a cylindrical part at the tip of the cleat.

6. Sole as claimed in claim 5 in which the length of the cylindrical part at the tip of each cleat is equal to the diameter of said part.

7. Sole as claimed in claim 2 which is made of the same material throughout its length as that constituting the layer in which the inner sole is embedded, the face of the sole from which the cleats project being provided with substantially pyramidal projections in the zone of the sole corresponding to the arch and heel.

8. Athletic shoe made with a sole according to claim 2.

* * * * *